US008443621B2

(12) United States Patent
Shin et al.

(10) Patent No.: US 8,443,621 B2
(45) Date of Patent: May 21, 2013

(54) ICE MAKER AND METHOD FOR MAKING ICE

(75) Inventors: Jong Min Shin, Busan (KR); Ju Hyun Kim, Jinhae (KR)

(73) Assignee: LG Electronics Inc., Seoul (KR)

( * ) Notice: Subject to any disclaimer, the term of this patent is extended or adjusted under 35 U.S.C. 154(b) by 626 days.

(21) Appl. No.: 11/969,076

(22) Filed: Jan. 3, 2008

(65) Prior Publication Data

US 2008/0156000 A1 Jul. 3, 2008

Related U.S. Application Data

(60) Provisional application No. 60/883,334, filed on Jan. 3, 2007.

(51) Int. Cl.

| | |
|---|---|
| ***F25C 1/24*** | (2006.01) |
| ***F25C 1/00*** | (2006.01) |
| ***F25D 3/02*** | (2006.01) |
| ***F25D 17/02*** | (2006.01) |

(52) U.S. Cl.
USPC ..... 62/350; 62/353; 62/420; 62/425; 62/377

(58) Field of Classification Search
USPC ..... 62/349, 351, 352, 377, 420, 425
See application file for complete search history.

(56) References Cited

U.S. PATENT DOCUMENTS

| | | | | |
|---|---|---|---|---|
| 2,871,673 | A | 2/1959 | Richards et al. | |
| 2,912,836 | A | 11/1959 | Harle | |
| 3,144,078 | A | 8/1964 | Evans et al. | |
| 3,308,632 | A * | 3/1967 | Winfield, Jr. | 62/137 |
| 3,788,089 | A | 1/1974 | Graves | |
| 4,199,956 | A * | 4/1980 | Lunde | 62/138 |
| 4,922,723 | A | 5/1990 | Broadbent | |
| 5,127,236 | A * | 7/1992 | von Blanquet | 62/135 |
| 5,203,176 | A | 4/1993 | De Weered | |
| 5,297,394 | A * | 3/1994 | Frohbieter et al. | 62/135 |
| 5,408,844 | A * | 4/1995 | Stokes | 62/351 |
| 5,787,723 | A | 8/1998 | Mueller et al. | |
| 6,205,807 | B1 | 3/2001 | Broadbent | |
| 6,425,259 | B2 | 7/2002 | Nelson et al. | |
| 7,017,364 | B2 * | 3/2006 | Lee et al. | 62/351 |
| 7,188,479 | B2 | 3/2007 | Anselmino et al. | |
| 7,681,406 | B2 * | 3/2010 | Cushman et al. | 62/72 |
| 2001/0025505 | A1 | 10/2001 | Nelson et al. | |

(Continued)

OTHER PUBLICATIONS

U.S. Office Action issued in U.S. Appl. No. 11/969,024 dated Oct. 15, 2009.

(Continued)

*Primary Examiner* — Frantz Jules
*Assistant Examiner* — Cassey D Bauer
(74) *Attorney, Agent, or Firm* — KED & Associates LLP

(57) ABSTRACT

The present invention relates to an ice maker and a method for making ice, and more particularly, to an ice maker provided in a refrigerating chamber of a refrigerator and an ice making method. According to an ice maker and an ice making method, there is no need for forming an additional duct to supply cold air to the ice maker in order to make ice, whereby it is possible to simplify a manufacturing process of a refrigerator and to reduce manufacturing costs of a refrigerator. In addition, since a portion of refrigerant used in a refrigeration cycle of the refrigerator is used for making ice, no additional energy is required for making ice, thereby reducing energy consumption.

13 Claims, 11 Drawing Sheets

U.S. PATENT DOCUMENTS

| | | | | |
|---|---|---|---|---|
| 2003/0167787 | A1* | 9/2003 | Ohashi et al. | 62/443 |
| 2004/0083753 | A1 | 5/2004 | Kim et al. | |
| 2004/0107721 | A1* | 6/2004 | Choi et al. | 62/340 |
| 2004/0237565 | A1 | 12/2004 | Lee et al. | |
| 2005/0061016 | A1 | 3/2005 | Lee et al. | |
| 2005/0061018 | A1* | 3/2005 | Kim et al. | 62/344 |
| 2005/0067406 | A1* | 3/2005 | Rajarajan et al. | 219/553 |
| 2005/0126202 | A1 | 6/2005 | Shoukyuu et al. | |

OTHER PUBLICATIONS

U.S. Office Action issued in U.S. Appl. No. 11/969,067 dated Nov. 19, 2009.

U.S. Office Action issued in U.S. Appl. No. 11/969,024 dated May 17, 2010.

U.S. Office Action issued in U.S. Appl. No. 11/969,054 dated Jun. 1, 2010.

U.S. Office Action issued in U.S. Appl. No. 11/969,054 dated Jan. 12, 2012.

U.S. Office Action issued in U.S. Appl. No. 11/969,067 dated Jan. 17, 2012.

U.S. Office Action issued in U.S. Appl. No. 11/969,054 dated Apr. 25, 2012.

U.S. Office Action issued in U.S. Appl. No. 11/969,067 dated Apr. 25, 2012.

U.S. Office Action issued in U.S. Appl. No. 11/969,024 dated May 4, 2012.

* cited by examiner

ICE MAKER AND METHOD FOR MAKING ICE

This application claim priority to U.S. Provisional Application No. 60/883,334 filed Jan. 3, 2007, which is hereby incorporated by reference.

BACKGROUND OF THE INVENTION

1. Field of the Invention

The present invention relates to an ice maker and a method for making ice, and more particularly, to an ice maker provided in a refrigerating chamber of a refrigerator and an ice making method.

2. Description of the Related Art

Generally, a refrigerator is an electric home appliance for storing foods in a relatively low temperature state so that the foods can be kept in a fresh state for an extended period of time.

Specifically, a refrigerator includes a refrigerating chamber that is maintained in a temperature range of 1 to 4° C. to store foods such as vegetables in a fresh state, and a freezing chamber that is maintained at about −18° C. to store foods such as meat or fish in a frozen state.

In addition, refrigerators are classified into a type in which a freezing chamber is positioned above a refrigerating chamber, a type in which a freezing chamber is positioned below a refrigerating chamber, and a type in which a freezing chamber and a refrigerating chamber are positioned side by side.

Alternatively, refrigerators may be classified into a side-by-side door refrigerator having right and left doors, and a single-side door refrigerator having upper and lower doors.

Furthermore, an ice maker for making ice and an ice bank for storing the ice are provided in any one of the refrigerating chamber and the freezing chamber.

Specifically, in a case where the ice maker and the ice bank are provided in the freezing chamber, water stored in the ice maker is made into ice by means of a refrigerant that has passed through an evaporator, and the ice falls into the ice bank provided below the ice maker and is stored therein.

Meanwhile, in a case where the ice maker is provided in the refrigerating chamber, there is a difficult problem in that it is not easy to make ice using cold air supplied to the refrigerating chamber since the refrigerating chamber is kept at a temperature above zero. That is, in a case where the ice maker is provided in the refrigerating chamber, there is a problem in that ice cannot be completely made, or the ice is immediately melted although being made.

SUMMARY OF THE INVENTION

The present invention is conceived to solve the aforementioned problems in the prior art. Accordingly, an object of the present invention is to provide an ice maker and an ice making method, which facilitate to make ice although an ice maker is provided in a refrigerating chamber.

Another object of the present invention is to provide an ice maker and an ice making method, which allow the ice to be easily separated from the ice maker after the ice is made.

A further object of the present invention is to provide an ice maker and an ice making method, wherein ice is prevented from falling into an ice bank together with water due to provision of excessive heat in an ice-releasing process and the ice stored in the ice bank is prevented from being stuck together due to the falling water.

An ice maker according to one aspect of the present invention for achieving the objects comprises an ice-making tray disposed at one side of a refrigerating chamber to store a water to be used for making ice; and an ice-making pipe for freezing the water stored in the ice-making tray, wherein in an ice-releasing process, the ice-making tray is instantly heated by applying power thereto.

A method for making ice according to one aspect of the present invention comprises the steps of storing water to be used for making ice in an ice-making tray; freezing the water stored in the ice-making tray by causing a refrigerant of relatively low temperature to flow into an ice-making pipe; after ice is completely made, applying power to the ice-making tray to instantly heat the ice-making tray; and releasing the ice from the ice-making tray.

With the structure described above, ice can be made in a refrigerating chamber, and ice water is not generated in an ice-releasing process.

DESCRIPTION OF THE PREFERRED EMBODIMENT

Hereinafter, a specific embodiment of the present invention will be described in detail with reference to the accompanying drawings. However, the spirit of the present invention is not limited to the following embodiment, and retrograde embodiments or other embodiments included in the scope of the present invention can be easily conceived by adding, changing or eliminating other components.

Figure 1:
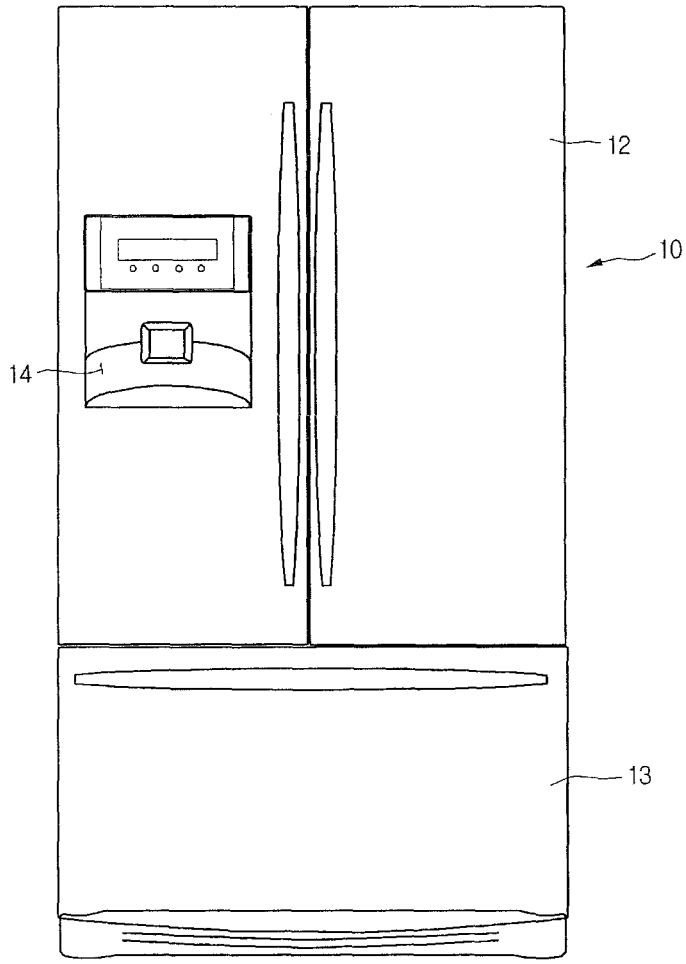
FIG. 1 is a front view of a refrigerator having an ice maker according to the present invention.
Figure 2:
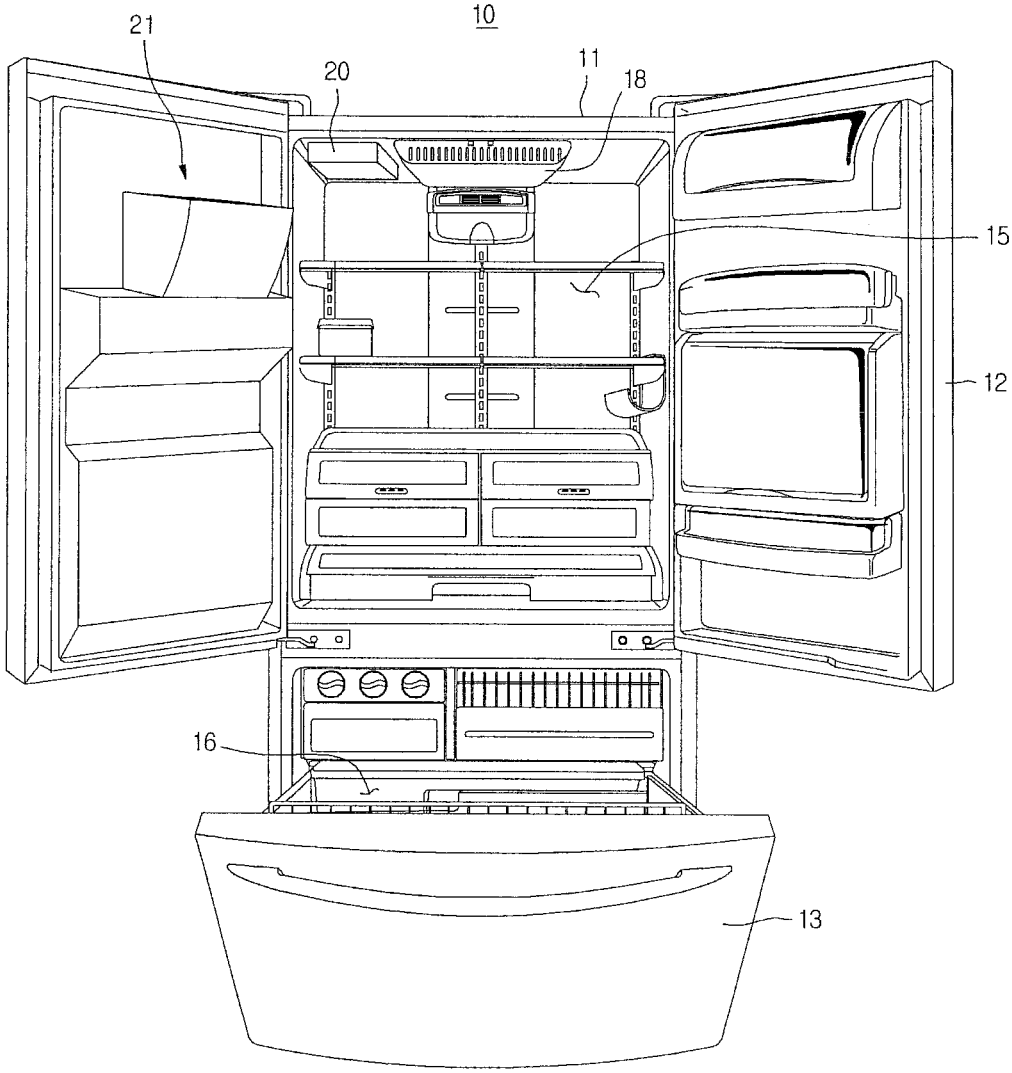
FIG. 2 is a perspective view showing the interior of the refrigerator according to the present invention.
Figure 3:
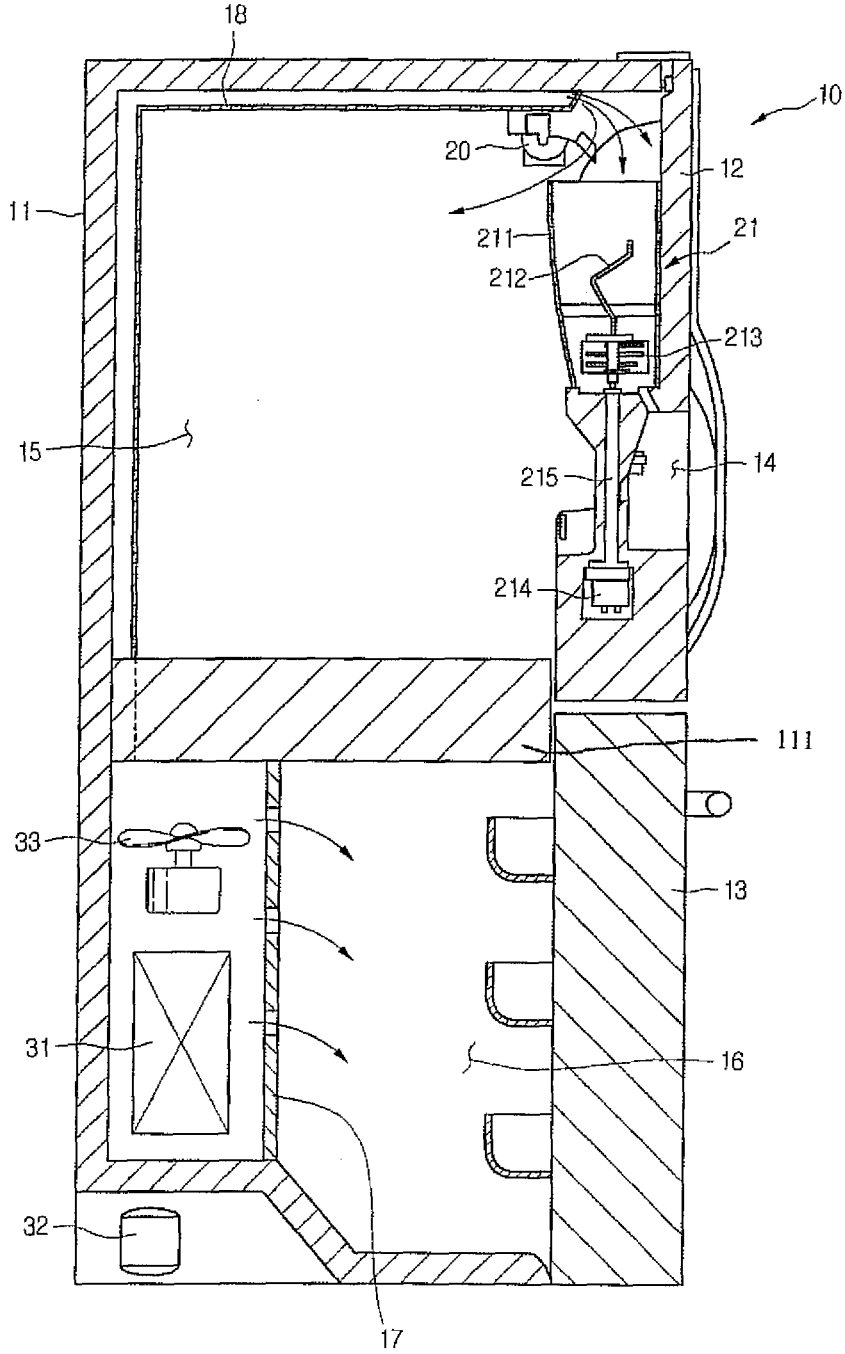
FIG. 3 is a side sectional view of the refrigerator according to the present invention.

FIG. 1 is a front view of a refrigerator having an ice maker according to the present invention, FIG. 2 is a perspective view showing the interior of the refrigerator according to the present invention, and FIG. 3 is a side sectional view of the refrigerator according to the present invention.

Referring to FIGS. 1 to 3, the refrigerator of the present invention will be described by way of example in connection with a bottom-freezer type refrigerator in which a refrigerating chamber is provided at an upper portion and a freezing chamber is provided at a lower portion.

The refrigerator 10 of the present invention includes a main body 11 having a refrigerating chamber 15 and a freezing chamber 16 provided therein, refrigerating chamber doors 12 for opening or closing the refrigerating chamber 15, and a freezing chamber door 13 for opening or closing the freezing chamber 16. Specifically, the refrigerating chamber 15 and the freezing chamber 16 are partitioned by means of a barrier 111.

In addition, the refrigerator 10 further includes a compressor 32 provided at a lower portion of the main body 11 to compress a refrigerant, an evaporator 31 disposed at a rear portion of the main body 11 to generate cold air, and a blower fan 33 for causing the cold air generated by the evaporator 31 to be supplied into the refrigerating chamber 15 and the freezing chamber 16.

Moreover, the refrigerator 10 further includes a freezing duct 17 for supplying the cold air blown by the blower fan 33 to the freezing chamber 16, a refrigeration duct 18 for supplying the cold air to the refrigerating chamber 15, an ice maker 20 provided on a ceiling of the refrigerating chamber 15, an ice bank 21 for storing ice made by the ice maker 20, and an ice dispenser 14 for dispensing the ice stored in the ice bank 21.

Specifically, the freezing duct 17 is provided with a plurality of cold air holes, and the cold air is discharged into the freezing chamber 16 through the cold air holes. Here, in addition to the structure in which the evaporator 31 and the blower fan 33 are disposed in the freezing duct 17, the evaporator 31 and the blower fan 33 may be provided in a separate space in the main body 11 and a freezing duct 17 connected to the freezing chamber 16 may be separately provided.

Furthermore, the refrigeration duct 18 extends from a space where the evaporator 31 is accommodated, and is then connected to the refrigerating chamber 15 through the barrier 111. Here, in addition to the structure in which the refrigeration duct 18 communicates directly with the space with the evaporator 31 accommodated therein, it should be noted that the refrigeration duct 18 may be branched off from the freezing duct 17.

As shown in the figures, the refrigerating chamber doors 12 are generally provided as side-by-side doors, and the freezing chamber door 13 is generally in the form of a drawer-type door. However, the freezing chamber door 13 may also be provided in the form of side-by-side doors.

With the structure described above, ice made by the ice maker 20 provided on the ceiling of the refrigerating chamber 15 is separated from an ice-making tray (which will be described later) and then falls into the ice bank 21. Here, a guide extending from the ice maker 20 or the ice bank 21 may be provided such that the ice separated from the ice maker 20 can safely fall into the ice bank 21.

Specifically, the ice bank 21 has an upper face in the form of an opening, and the opening of the ice bank 21 is positioned below the ice maker 20 when the refrigerating chamber doors 12 are closed.

Meanwhile, in a case where the ice bank 21 is provided in the refrigerating chamber 15 or the refrigerating chamber door 12, there may be a phenomenon by which ice stored in the ice bank is melted and stuck together since the refrigerating chamber 15 is kept at a temperature above zero.

To solve this problem, it is necessary to always maintain the interior of the ice bank 21 at a temperature below zero so that ice is not melted.

Hereinafter, a preferred embodiment of maintaining the interior of the ice bank 21 so that ice is not melted will be described.

The refrigerator 10 of the present invention is constructed such that the ice maker 20 and the ice bank 21 are disposed in the refrigerating chamber.

Specifically, the ice bank 21 includes a cylindrical container 211 with an open upper portion, an auger 212 provided at an inner lower portion of the container 211 to guide ice downward, a crusher 213 integrally connected to a lower end of the auger 212 to crush ice, a motor 214 for driving the crusher 213, and a shaft 215 for connecting the motor 214 to the crusher 213 so as to transmit a rotational force of the motor. Here, the container 211 is not limited to the cylinder-shaped one, but may have a variety of shapes.

Furthermore, the ice maker 20 is provided at a side of the ceiling of the refrigerating chamber 15. Specifically, the ice maker 20 is positioned above the ice bank 21 such that ice discharged from the ice maker 20 can fall into the container 211. The configuration of the ice maker 20 and an ice-making process using the same will be described below with reference to the accompanying drawings.

Meanwhile, the refrigeration duct 18 communicates with the space where the evaporator 31 is accommodated, and then extends upward along a wall of the refrigerating chamber 15 and to the ceiling of the refrigerating chamber 15. Then, an end of the refrigeration duct 18 extends to a front portion of the refrigerating chamber 15 and is positioned above the container 211. Thus, cold air flowing along the refrigeration duct 18 is discharged forward, and a portion of the discharged cold air falls into the container, and the remainder of the cold air circulates in the refrigerating chamber 15.

With this structure, at least a portion of cold air, which has been cooled to a relatively lower temperature while passing through the evaporator 31, is discharged directly into the container 211, thereby effectively preventing a phenomenon by which ice accommodated in the container 211 is melted and stuck together.

Further, since the refrigeration duct 18 extends to the front portion of the refrigerating chamber 15 and the cold air discharged from the refrigeration duct 18 is discharged downward, it is possible to obtain an air curtain effect.

Figure 4:
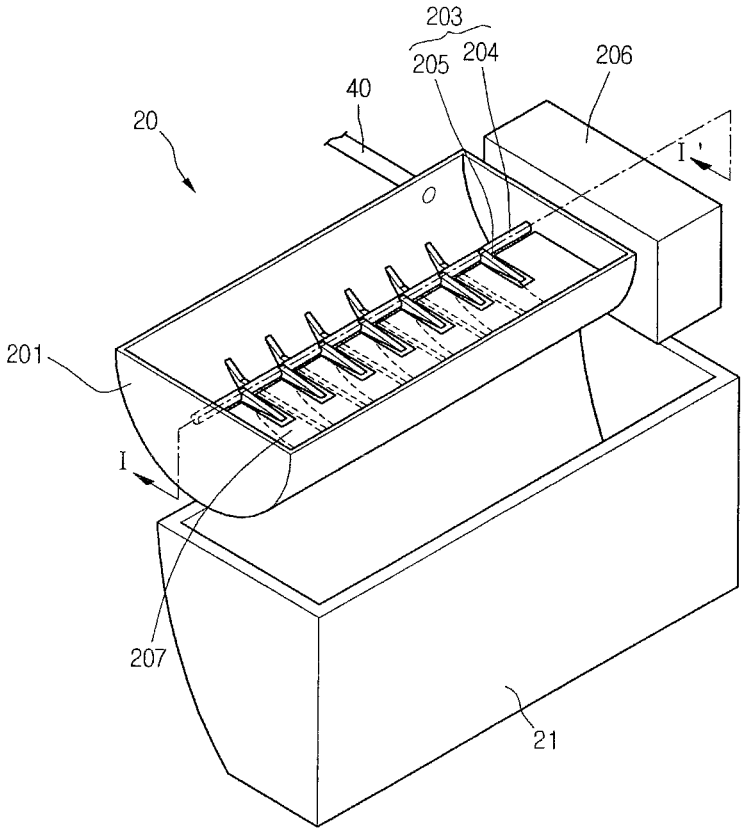
FIG. 4 is a view showing an ice-making system according to the present invention.

FIG. 4 is a view showing an ice-making system according to the present invention.

Hereinafter, in order to clarify the spirit of the present invention, descriptions on supplementary components constituting the ice maker, i.e., components that do not directly have influence on the present invention, such as a case or a cover, will be omitted since they may be substantially identical to those of a conventional ice maker.

Referring to FIG. 4, the ice-making system according to the present invention includes the ice maker 20, and the ice bank 21 for storing the ice that is made in the ice maker 20 and then falls into the ice bank 21.

Specifically, the ice maker 20 includes an ice-making tray 201 for storing drinkable water to be used for making ice, an ejector 203 rotatably provided in the ice-making tray 201, and a motor 206 for rotating the ejector 203.

More specifically, a plurality of partition ribs 207 are arranged at regular intervals in the ice-making tray 201, so that the ice-making tray 201 is partitioned into a plurality of spaces. Also, water stored in each of the partitioned spaces is cooled, whereby ice is made.

Furthermore, the ejector 203 includes a rotary shaft 204 connected to the motor 206 and rotated by the motor, and ejector pins 205 extending from the rotary shaft 204. Specifically, the ejector pins 205 are rotated as the rotary shaft 204 rotates, and the rotation of the ejector pins 205 causes the ice to be separated formed in the partitioned spaces of the ice-making tray 201.

Meanwhile, an ice-making pipe 40 is provided inside or outside the ice-making tray 201. The configuration of the ice-making pipe 40 will be explained in more detail below with reference to the accompanying drawings.

With the configuration described above, the water is supplied to the ice-making tray 201, and a refrigerant of relatively low temperature then flows through the ice-making pipe 40 to freeze the drinkable water. In addition, if the water is completely frozen, the ejector 203 rotates to separate the ice, and the separated ice falls into the ice bank 21 and is stored therein.

At this time, the ice-making tray 201 may be made of self-heating material so that ice can be separated from the inner circumference of the ice-making tray 201.

Specifically, the ice-making tray 201, which is formed by injection molding resin containing carbon components, instantly generates heat when power is applied to the ice-making tray 201. In addition, due to the instant heating, ice is not melted but released from the ice-making tray 201. That is, it is characteristic that ice is not melted when being released. In a conventional refrigerator, a heater is embedded in the ice-making tray 201 to heat the ice-making tray 201. In such a case, ice is melted since the ice-making tray 201 is heated over a temperature required for releasing ice.

However, since the ice-making tray 201 of the present invention is instantly heated for a short period of time, it is possible to supply only the heat required for releasing ice from the ice-making tray 201. Thus, the ice is released while keeping its frozen state, so that water generated from the molten ice can be prevented from falling into the ice bank together with ice, thereby preventing the ice in the ice bank from being stuck together.

Figure 5:
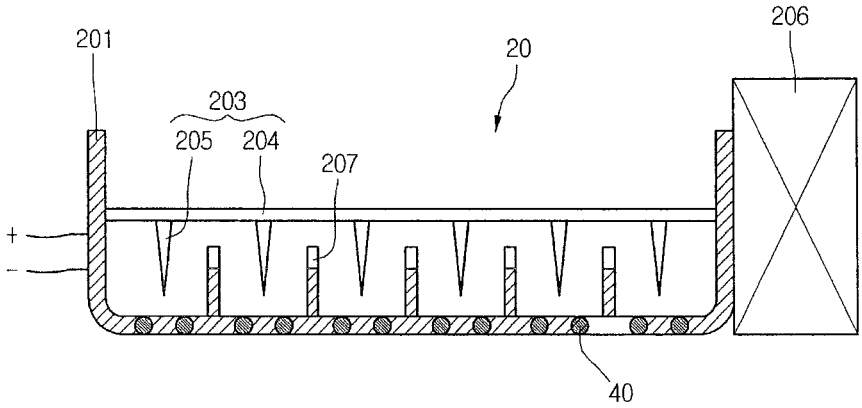
FIG. 5 is a sectional view taken along line I-I' of FIG. 4.

FIG. 5 is a sectional view taken along line I-I' of FIG. 4.

Referring to FIG. 5, the ice-making pipe 40 is embedded in the ice-making tray 201 to freeze the drinkable water stored therein.

Specifically, as shown in the figure, the ice-making pipe 40 is spaced apart by a certain interval from the ejector 203 to cross it, and may be meanderingly arranged in an "S" shape.

With the structure described above, in the ice-making process, a refrigerant of relatively low temperature and low pressure is allowed to flow into the ice-making pipe 40 to thereby make ice. Then, if an ice-releasing process is initiated after the ice-making process is completed, power is applied to the ice-making tray 201, thereby instantly heating the ice-making tray 201. Thus, the ice formed in the ice-making tray 201 is slightly melted and then is separated from the inner circumference of the ice-making tray 201. Thereafter, if the ejector 203 rotates, the ejector pins 205 rotate the ice separated from the inner circumference of the ice-making tray 201. Thus, the separated ice falls into the ice bank 21.

Figure 6:
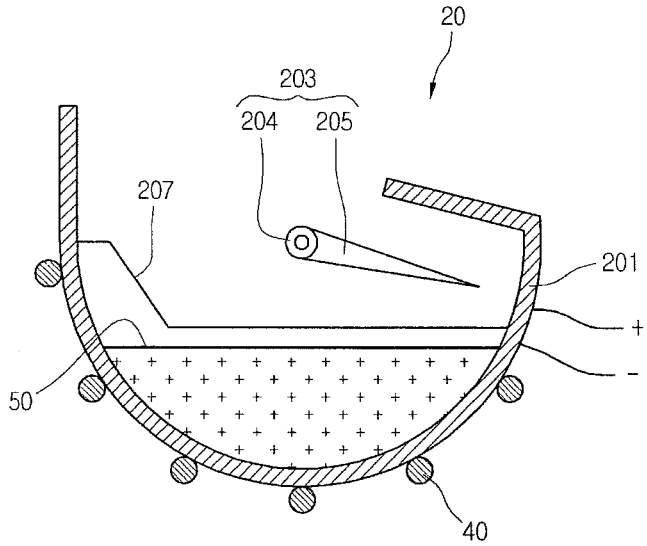
FIG. 6 is a sectional view showing another embodiment of an ice-making tray according to the present invention.

FIG. 6 is a sectional view showing another embodiment of an ice-making tray according to the present invention.

Referring to FIG. 6, this embodiment of the present invention is characterized in that an ice-making pipe 40 provided in an ice-making tray 201 is arranged in the same direction as an ejector 203.

Specifically, the ice-making pipe 40 is meanderingly arranged in an "S" shape.

Although it is illustrated in the figure that the ice-making pipe 40 is provided on an outer circumference of the ice-making tray 201, the present invention is not limited thereto. That is, the ice-making pipe 40 may be embedded in the ice-making tray 201.

In addition thereto, the ice-making and ice-releasing processes are identical to those of the previous embodiment shown in FIG. 5.

Figure 7:
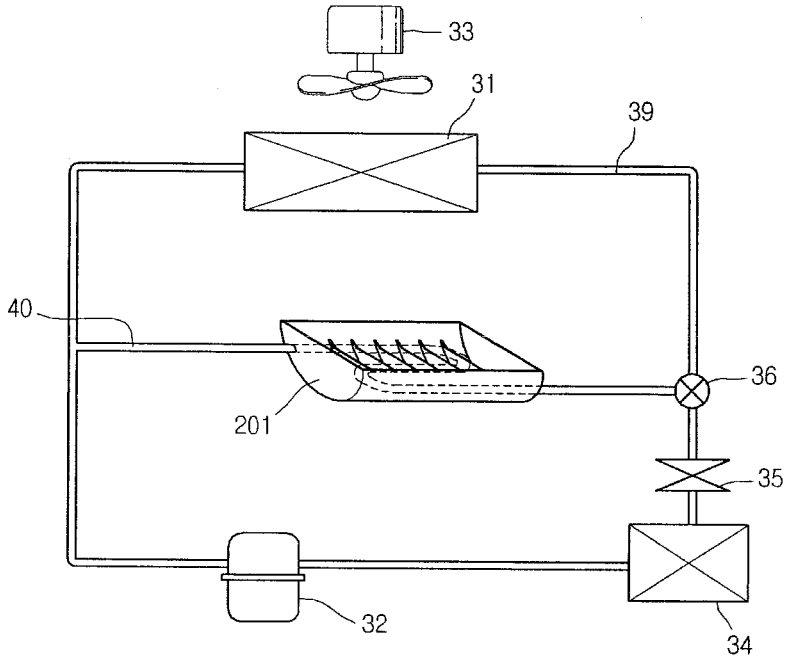
FIG. 7 is a systematic view showing a refrigeration cycle of a refrigerator provided with the ice maker according to the present invention.

FIG. 7 is a systematic view showing a refrigeration cycle of a refrigerator provided with the ice maker according to the present invention.

Referring to FIG. 7, the refrigerant circulating system of a refrigerator according to the present invention includes a compressor 32 for compressing a refrigerant, a condenser 34 for condensing the refrigerant compressed at relatively high temperature and high pressure by the compressor 32, an expansion valve 35 for expanding the refrigerant, which has passed through the condenser 34, into a refrigerant of relatively low temperature and low pressure, and an evaporator 31 for heat exchanging the refrigerant, which has passed through the expansion valve, with air. In addition, the compressor 32, the condenser 34, the expansion valve 35 and the evaporator 31 are connected through refrigerant pipes 39.

Specifically, a blower fan 33 is provided at one side of the evaporator 31, so that cold air, which passes through the evaporator and is cooled by the heat exchange, is supplied to the refrigerating chamber or freezing chamber. In addition, the ice-making pipe 40 is branched off from an outlet of the expansion valve 35 and connected to an outlet of the evaporator 31. Also, a valve 36 is provided at a point where the ice-making pipe 40 is branched off, so that a portion of the refrigerant, which has passed through the expansion valve 35 in the ice-making process, is caused to flow to the ice-making pipe 40.

Further, the ice-making pipe 40 is attached to a surface of the ice-making tray 201 or embedded therein. In addition, a power line is connected to the ice-making tray 201 in order to supply power thereto.

With the configuration described above, in the ice-making process, the degree of opening of the valve 36 is controlled, so that a portion of the refrigerant, which has passed through the expansion valve 35, flows into the ice-making pipe 40. Then, water stored in the ice-making tray 201 is frozen. In addition, if the ice-making process is completed, the degree of opening of the valve 36 is controlled to block the refrigerant from flowing toward the ice-making pipe 40, and power is applied to the ice-making tray 201.

Specifically, the ice-making tray 201 separates the ice formed in the ice-making tray 201 therefrom by the heating operation of the ice-making tray 201, and the ejector 203 is then rotated to release the ice from the ice-making tray 201. Then, the released ice falls into the ice bank 21 and is stored therein.

Figure 8:
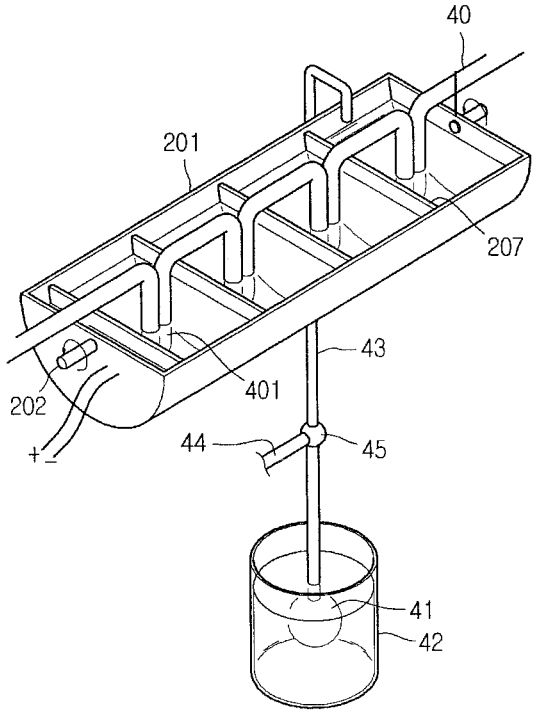
FIG. 8 is a view showing another embodiment of the ice maker according to the present invention.

FIG. 8 is a view showing another embodiment of the ice maker according to the present invention.

Referring to FIG. 8, the ice maker according to this embodiment includes an ice-making tray 201, an ice-making pipe 40 extending to the interior of the ice-making tray 201, and a water supplier for supplying water to the ice-making tray 201.

Specifically, the water supplier includes a water container 42 for storing water, a pump 41 for pumping water into the water container 42, and a water supply pipe 43 extending from the pump 41 to the ice-making tray 201. In addition, a dispenser connection pipe 44 may be branched off from any one side of the water supply pipe 43, and a switching valve 45 may be mounted at the branch point, so that it is possible to selectively control a water flow direction. In more detail, the dispenser connection pipe 44 may extend toward a dispenser, thereby enabling a user to take drinking water.

Meanwhile, rotary shafts 202 extend from both sides of the ice-making tray 201, respectively, and are connected to a case (not shown) surrounding the ice-making tray 201. In addition, the interior of the ice-making tray 201 is partitioned into a plurality of spaces by partition ribs 207.

In addition, the ice-making pipe 40, which is a pipe for allowing a portion of the refrigerant in the refrigeration cycle to flow therein, is identical to the ice-making pipe 40 proposed in FIG. 7.

Meanwhile, the ice-making pipe 40 is curved or bent several times to form protrusions 401 as shown in the figure. In addition, the protrusions 401 are respectively disposed in the spaces partitioned by the partition ribs 207. The protrusions 401 are partially submerged in the water stored in the ice-making tray 201.

Hereinafter, the ice-making and ice-releasing processes of the ice maker configured as above will be described with reference to the accompanying drawings.

Figure 9:
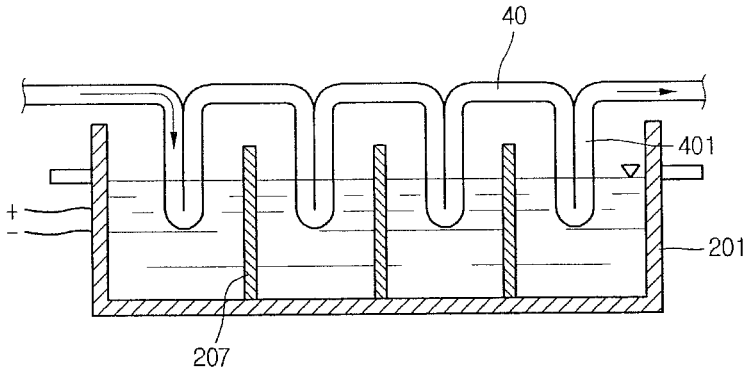
FIGS. 9 to 11 are views illustrating ice-making and ice-releasing processes of the other embodiment of the ice maker according to the present invention.
Figure 10:
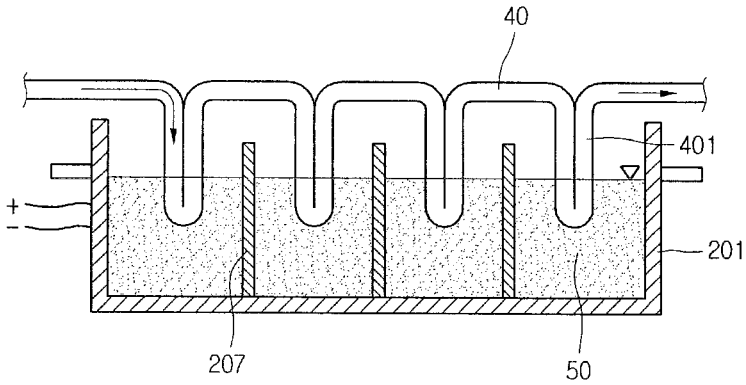
Figure 11:
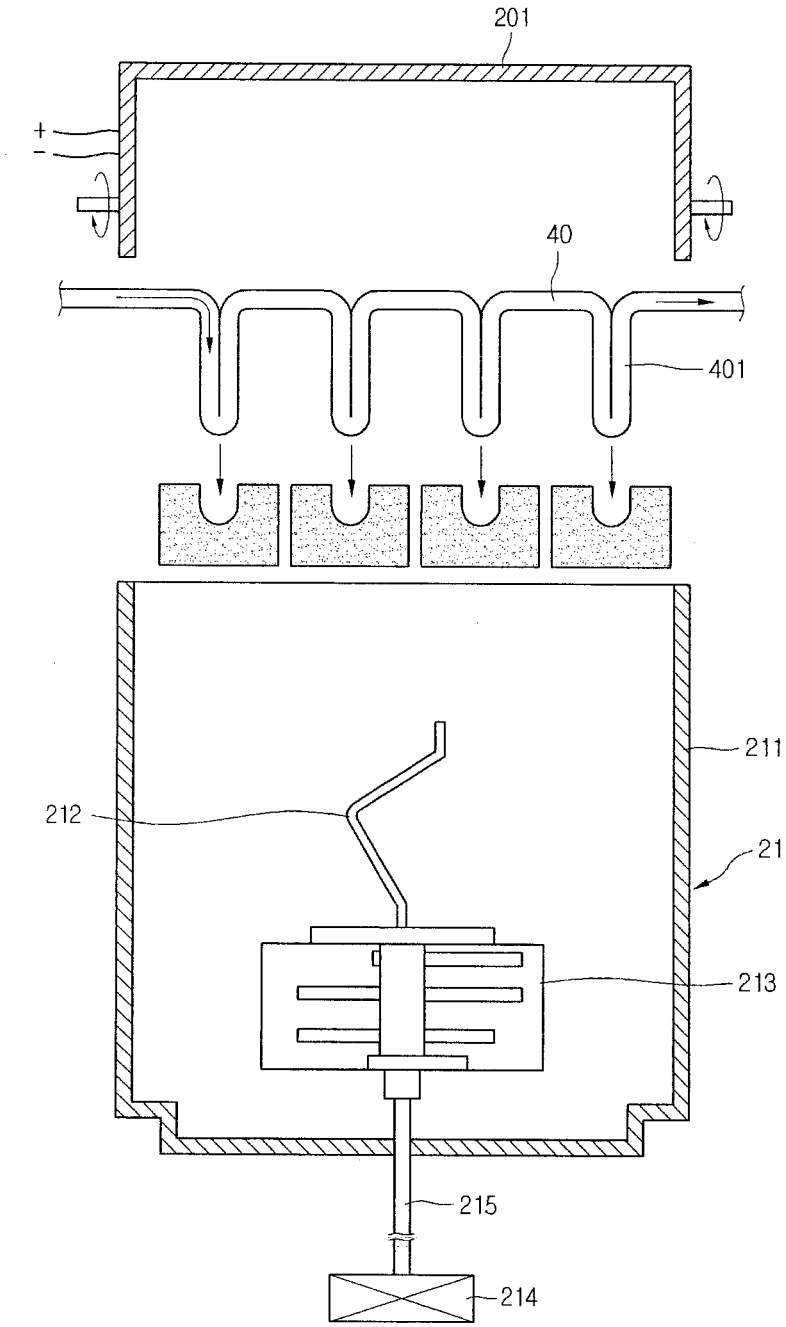

FIGS. 9 to 11 are views illustrating the ice-making and ice-releasing processes of the other embodiment of the ice maker according to the present invention.

Referring to FIGS. 9 to 11, drinkable water is first supplied into the ice-making tray 201, and the supplied drinkable water is stored in the respective spaces partitioned by the partition ribs 207. Then, the supplied drinkable water is filled up to the extent that the protrusions of the ice-making pipe 40 are submerged therein.

If the water is completely supplied, a refrigerant of relatively low temperature and low pressure is caused to flow in the ice-making pipe 40, thereby freezing the water in the ice-making tray 201. Then, if the water supplied to the ice-making tray 201 is completely frozen, the refrigerant stops being supplied to the ice-making pipe 40. Thereafter, power is applied to the ice-making tray 201, whereby the ice-making tray 201 instantly generates heat. If the ice-making tray 201 is instantly heated to completely release the ice 50, the ice-making tray 201 is rotated 180 degrees about the rotary shaft 202.

At this time, the ice 50 separated due to the rotation of the ice-making tray 201 is still suspended to the protrusions 401. In such a state, the ice-making pipe 40 is heated to thereby release the ice from the ice-making pipe 40. Then, the released ice falls into the ice bank 21 and is stored therein.

A structure and method for separating ice from the ice-making pipe 40 will be described with reference to the accompanying drawings.

Figure 12:
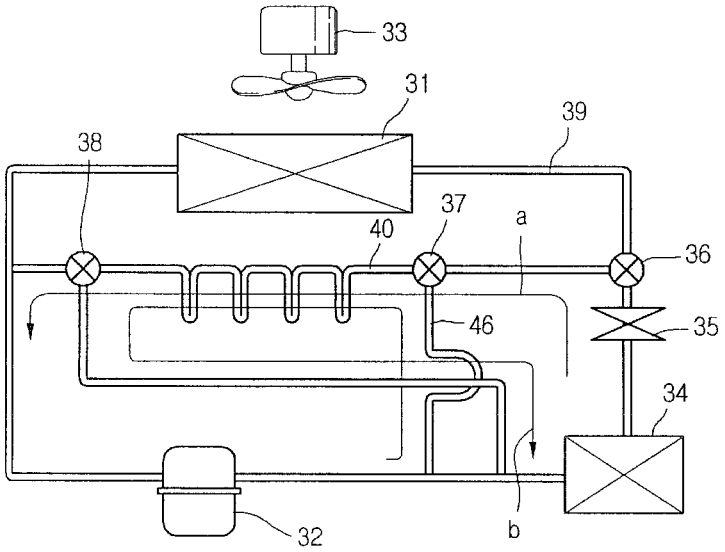
FIG. 12 is a view showing a system for separating ice from an ice-making pipe.

FIG. 12 is a view showing a system for separating ice from an ice-making pipe.

Referring to FIG. 12, the ice separating system of a refrigerator according to the present invention includes a compressor 32 for compressing a refrigerant, a condenser 34 for condensing the refrigerant compressed at high temperature and high pressure by the compressor 32, an expansion valve 35 for expanding the refrigerant, which has passed through the condenser 34, into a refrigerant of relatively low temperature and low pressure, and an evaporator 31 for heat exchanging the refrigerant, which has passed through the expansion valve, with air. In addition, the compressor 32, the condenser 34, the expansion valve 35 and the evaporator 31 are connected through refrigerant pipes 39.

Specifically, a blower fan 33 is provided at one side of the evaporator 31, so that cold air, which passes through the evaporator and is cooled by the heat exchange, is supplied to the refrigerating chamber or freezing chamber. In addition, the ice-making pipe 40 is branched off from an outlet of the expansion valve 35, and an outlet of the ice-making pipe 40 is branched off into two paths, which are respectively connected to an outlet of the evaporator 31 and an inlet of the condenser 34. A first valve 36 is mounted at the point where the ice-making pipe 40 is branched off from the outlet of the expansion valve 35, and controls so that a portion of the refrigerant having passed through the expansion valve 35 selectively flows into the ice-making pipe 40. In addition, a third valve 38 is provided at the point where the outlet of the ice-making pipe 40 is branched off into the two paths so that the refrigerant is caused to selectively flow to any one of the outlet of the evaporator 31 and the inlet of the condenser 34. An ice-releasing pipe 46 is also branched off from an outlet of the compressor 32 and extends to an inlet of the ice-making pipe 40. In addition, a second valve 37 is provided at the point where the ice-releasing pipe 46 meets the inlet of the ice-making pipe 40, so that a portion of the refrigerant of relatively high temperature and high pressure is caused to selectively flow to the ice-making pipe 40.

The refrigerant circulating process performed in ice-making and ice-releasing processes of the refrigerant system configured as above will be described.

First, when a refrigerator is operated, the refrigeration cycle works. That is, the refrigerant is compressed by the compressor 32 into a vapor refrigerant of relatively high temperature and high pressure, and the compressed refrigerant is heat exchanged with the external air while passing through the condenser 34 and is thus changed into a liquid refrigerant of relatively high temperature and high pressure. Then, the refrigerant, which has passed through the condenser 34, passes through the expansion valve 35 and is changed into a two-phase refrigerant of relatively low temperature and low pressure. Thereafter, the two-phase refrigerant of relatively low temperature and low pressure is heat exchanged with the external air while passing the evaporator 31 and is changed into a vapor refrigerant of relatively low temperature and low pressure. The air that is heat exchanged in the evaporator 31 becomes in a low temperature state and is then supplied to the refrigerating chamber or the freezing chamber by means of the blower fan 33. Also, the refrigerant, which has passed through the evaporator 31, is introduced into the compressor 32 again.

Specifically, in the ice-making process, a portion of the refrigerant flows along a line a, while in the ice-releasing process, the other portion of the refrigerant flows along a line b.

More specifically, the degree of opening of the first valve 36 is controlled while the ice-making process is performed, so that a portion of the refrigerant, which has passed through the expansion valve 35, is supplied to the ice-making pipe 40. Then, the refrigerant, which has passed through the ice-making pipe 40, freezes the water stored in the ice-making tray 201. The refrigerant, which has passed through the ice-making pipe 40, is moved toward the outlet of the evaporator 31 and is then introduced into the compressor 32 again.

Meanwhile, if the ice-making process is completed and the ice-releasing process is initiated, the degree of opening of the first valve 36 is again controlled to block the refrigerant of relatively low temperature and low pressure from being supplied to the ice-making pipe 40. Then, power is applied to the ice-making tray 201 to thereby separate ice from the ice-making tray 201. The second valve 37 is controlled in a state where the ice-making tray 201 is rotated 180 degrees so that the vapor refrigerant of relatively high temperature and high pressure flowing along the ice-releasing pipe 46 is supplied to the ice-making pipe 40. Then, as the temperature of the ice-making pipe 40 increases, the ice adhering to the protrusions 401 of the ice-making pipe 40 is separated therefrom.

In addition, in the ice-releasing process, the degree of opening of the third valve 38 is controlled so that the refrigerant, which has passed through the ice-making pipe 40, flows again toward the outlet of the compressor 32.

Here, the point where the outlet end of the ice-making pipe 40 is connected is not limited to the illustrated embodiment, but may be changed appropriately. Further, in addition to the method where the refrigerant having passed through the compressor flows to the ice-making pipe 40 in the ice-releasing process, the cycle may also be configured so that the refrigerant having passed through the condenser flows into the ice-making pipe 40.

Figure 13:
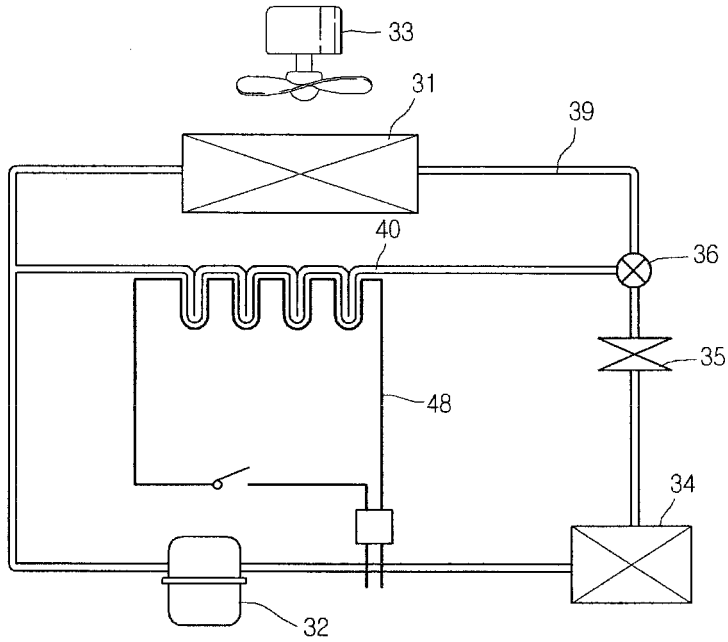
FIG. 13 is a view showing another embodiment of the system for separating ice from an ice-making pipe.

FIG. 13 is a view showing another embodiment of the system for separating ice from an ice-making pipe.

Referring to FIG. 13, the ice separating system of a refrigerator according to the present invention includes a compressor 32 for compressing a refrigerant, a condenser 34 for condensing the refrigerant compressed at high temperature and high pressure by the compressor 32, an expansion valve 35 for expanding the refrigerant, which has passed through the condenser 34, into a refrigerant of relatively low temperature and low pressure, and an evaporator 31 for heat exchanging the refrigerant, which has passed through the expansion valve, with air. In addition, the compressor 32, the condenser 34, the expansion valve 35 and the evaporator 31 are connected through refrigerant pipes 39.

Specifically, a blower fan 33 is provided at one side of the evaporator 31, so that cold air, which passes through the evaporator and is cooled by the heat exchange, is supplied to the refrigerating chamber or freezing chamber. In addition, the ice-making pipe 40 is branched off from an outlet of the expansion valve 35 and connected to an outlet of the evaporator 31. Also, a valve 36 is provided at a point where the ice-making pipe 40 is branched off, so that a portion of the refrigerant, which has passed through the expansion valve 35 in the ice-making process, is caused to flow to the ice-making pipe 40. In addition, a heater 48 is attached to the surface of the ice-making pipe 40, so that the ice frozen on the protrusions 401 of the ice-making pipe 40 is separated therefrom.

The refrigerant circulating process performed in ice-making and ice-releasing processes of the refrigerant system configured as above will be described.

First, when a refrigerator is operated, the refrigeration cycle works. That is, the refrigerant is compressed by the compressor 32 into a vapor refrigerant of relatively high temperature and high pressure, and the compressed refrigerant is heat exchanged with the external air while passing through the condenser 34 and is thus changed into a liquid refrigerant of relatively high temperature and high pressure. Then, the refrigerant, which has passed through the condenser 34, passes through the expansion valve 35 and is changed into a two-phase refrigerant of relatively low temperature and low pressure. Thereafter, the two-phase refrigerant of relatively low temperature and low pressure is heat exchanged with the external air while passing the evaporator 31 and is changed into a vapor refrigerant of relatively low temperature and low pressure. The air that is heat exchanged in the evaporator 31 becomes in a low temperature state and is then supplied to the refrigerating chamber or the freezing chamber by means of the blower fan 33. Also, the refrigerant, which has passed through the evaporator 31, is introduced into the compressor 32 again.

Specifically, the degree of opening of the valve 36 is controlled while the ice-making process is performed, so that a portion of the refrigerant, which has passed through the expansion valve 35, is supplied to the ice-making pipe 40. Then, the refrigerant, which has passed through the ice-making pipe 40, freezes the water stored in the ice-making tray 201. The refrigerant, which has passed through the ice-making pipe 40, is moved toward the outlet of the evaporator 31 and is then introduced into the compressor 32 again.

Meanwhile, if the ice-making process is completed and the ice-releasing process is initiated, the degree of opening of the valve 36 is again controlled to block the refrigerant from flowing toward the ice-making pipe 40. Then, power is applied to the ice-making tray 201, so that the ice-making tray 201 instantly generates heat. If the ice is separated from the ice-making tray 201 due to the instant heating, the ice-making tray 201 is rotated 180 degrees. Then, in a state where the ice-making tray 201 is rotated, power is applied to the heater 48 and the heater 48 generates heat, so that the ice adhering to the protrusions 401 of the ice-making pipe 40 is separated therefrom.

The ice-making tray 201 generates heat by the instant heating, ice is separated from the ice-making tray 201 without being melted, thereby preventing water from a molten ice from being introduced into the ice bank. Furthermore, water is prevented from being introduced into the ice bank, whereby the ice in the ice bank is not stuck together.

According to the ice maker and the ice making method of the present invention as described above, there is no need for forming an additional duct to supply cold air to the ice maker in order to make ice, whereby it is possible to simplify a manufacturing process of a refrigerator and to reduce manufacturing costs of a refrigerator.

In addition, since a portion of refrigerant used in a refrigeration cycle of a refrigerator is used for making ice, no additional energy is required for making ice, thereby reducing energy consumption.

Further, although the ice maker is provided in a refrigerating chamber, the ice-making process can be smoothly performed.

Furthermore, since there is no need for forming an additional cold air flow passage to supply a portion of refrigerant to the ice maker in order to make ice, it is possible to secure a large inner space of the refrigerating or freezing chamber.

In addition, since the ice-making tray instantly generates heat, the made ice can be rapidly separated from the ice-making tray without being melted. Thus, it is possible to prevent ice from being melted and flowing down in the ice-releasing process.

What is claimed is:

1. A refrigerator, comprising:

a main body including at least one refrigerating chamber and at least one freezing chamber;

an ice-making tray disposed at one side of the at least one refrigerating chamber that receives water to be used to make ice;

an ice-making pipe that freezes the water received in the ice-making tray;

a container disposed in one of refrigerating chamber doors of the at least one refrigerating chamber so that an outer surface thereof is exposed to an inside of the at least one refrigerating chamber and configured to receive ice from the ice-making tray; and a cold air flow passage that supplies cold air to the container, to maintain ice received in the container in a frozen state wherein the cold air flow passage extends along a ceiling of the at least one refrigerating chamber, wherein:

one or more holes located at an end section of the cold air flow passage is the only hole or are the only holes that direct cold air into the at least one refrigerating chamber, the cold air passage is separated from being in communication with an interior of the at least one refrigerating chamber continuously from a first point to a second point, the first point corresponds to a point at which the cold air passage enters the at least one refrigerating chamber and the second point corresponds to a point where the one or more holes are located, and the cold air passage includes no air intake ports in the at least one refrigerating chamber between the first point and the second point, and wherein in an ice-releasing process, the ice-making tray is instantly heated by power applied to the tray.

2. The refrigerator according to claim 1, wherein the ice-making tray is formed by injection molding with resin containing carbon components.

3. The refrigerator according to claim 1, wherein an interior of the ice-making tray is partitioned into a plurality of spaces by a plurality of partition ribs.

4. The refrigerator according to claim 1, further comprising:

a plurality of protrusions formed by bending the ice-making pipe several times; and a heater provided on surfaces of the plurality of protrusions, wherein the plurality of protrusions is at least partially submerged in the water received in the ice-making tray.

5. The refrigerator according to claim 1, wherein in the ice-releasing process, the ice-making tray rotates after generating heat.

6. The refrigerator according to claim 1, wherein a refrigerant of relatively low temperature flows in the ice-making pipe in an ice-making process, and wherein a refrigerant of relatively high temperature flows in the ice-making pipe in the ice-releasing process.

7. The refrigerator according to claim 1, further comprising:

an ejector rotatably provided in the ice-making tray; and a motor that rotates the ejector.

8. The refrigerator according to claim 1, wherein the ice-making tray is fixed to the at least one refrigerating chamber.

9. The refrigerator as claimed in claim 1, wherein the cold air flow passage comprises a duct member having the one or more holes positioned above an opening of the container.

10. The refrigerator as claimed in claim 1, wherein the container is disposed adjacent to the cold air flow passage.

11. The refrigerator as claimed in claim 1, wherein the container has an opening at an upper portion, and at least a portion of the cold air discharged from the cold air flow passage through the one or more holes is discharged to the opening of the container.

12. The refrigerator as claimed in claim 11, wherein a remaining portion of the cold air discharged from the cold air flow passage through the one or more holes is discharged into the at least one refrigerating chamber.

13. The refrigerator as claimed in claim 1, wherein a portion of the cold air discharged from the cold air flow passage is supplied to the ice-making tray.

* * * * *